US012796732B2

(12) United States Patent
Jang et al.

(10) Patent No.: US 12,796,732 B2
(45) Date of Patent: Nov. 17, 2026

(54) AEROSOL GENERATING DEVICE

(71) Applicant: KT&G CORPORATION, Daejeon (KR)

(72) Inventors: Chul Ho Jang, Bucheon-si (KR); Gyoung Min Go, Daejeon (KR); Jangwon Seo, Daejeon (KR); Jin Chul Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 450 days.

(21) Appl. No.: 18/289,318

(22) PCT Filed: Aug. 11, 2023

(86) PCT No.: PCT/KR2023/011913
§ 371 (c)(1),
(2) Date: Nov. 2, 2023

(87) PCT Pub. No.: WO2024/063338
PCT Pub. Date: Mar. 28, 2024

(65) Prior Publication Data

US 2025/0098740 A1 Mar. 27, 2025

(30) Foreign Application Priority Data

Sep. 20, 2022 (KR) ..... 10-2022-0118321

(51) Int. Cl.
*A24F 40/05* (2020.01)
*A24F 40/10* (2020.01)
(Continued)

(52) U.S. Cl.
CPC ..... *A24F 40/05* (2020.01); *A24F 40/10* (2020.01); *A24F 40/42* (2020.01); *A24F 40/44* (2020.01); *A24F 40/51* (2020.01)

(58) Field of Classification Search
None
See application file for complete search history.

(56) References Cited

U.S. PATENT DOCUMENTS

2014/0000638 A1* 1/2014 Sebastian ..... A24F 40/30 131/328
2017/0280771 A1 10/2017 Courbat et al.
(Continued)

FOREIGN PATENT DOCUMENTS

CN 216019095 U 3/2022
JP 2018-528057 A 9/2018
(Continued)

OTHER PUBLICATIONS

International Search Report dated Nov. 8, 2023 in Application No. PCT/KR2023/011913.
(Continued)

*Primary Examiner* — Katherine A Will
(74) *Attorney, Agent, or Firm* — Sughrue Mion, PLLC

(57) ABSTRACT

The aerosol generating device includes a housing, a mouth side end, at least one cartridge configured to store an aerosol forming substrate, and an aerosol generator connected to the cartridge and configured to generate an aerosol, wherein the aerosol generator includes a substrate including a plate shape, at least one transducer disposed on the substrate, and an atomization region on a surface of the substrate, in which an aerosol is generated, wherein the substrate is disposed in the housing to form an acute angle with respect to a central axis that is parallel to a longitudinal direction of the housing, and the transducer is configured to convert an electrical signal into a surface acoustic wave (SAW), and the SAW is transferred to the atomization region through the substrate to aerosolize the aerosol forming substrate.

14 Claims, 10 Drawing Sheets

(51) Int. Cl.

| | |
|---|---|
| ***A24F 40/42*** | (2020.01) |
| ***A24F 40/44*** | (2020.01) |
| ***A24F 40/51*** | (2020.01) |

(56) References Cited

U.S. PATENT DOCUMENTS

| | | | |
|---|---|---|---|
| 2020/0060336 | A1 | 2/2020 | Liu et al. |
| 2021/0112882 | A1 | 4/2021 | Hejazi et al. |
| 2022/0022534 | A1 | 1/2022 | Inagaki et al. |

FOREIGN PATENT DOCUMENTS

| | | | |
|---|---|---|---|
| KR | 10-2017-0132823 | A | 12/2017 |
| KR | 10-2018-0121777 | A | 11/2018 |
| KR | 10-2019-0125308 | A | 11/2019 |
| KR | 10-2021-0157205 | A | 12/2021 |
| KR | 10-2022-0119436 | A | 8/2022 |
| KR | 10-2022-0119440 | A | 8/2022 |
| WO | 2021/129987 | A1 | 7/2021 |
| WO | 2022/112781 | A1 | 6/2022 |

OTHER PUBLICATIONS

Office Action issued Mar. 6, 2024 in Korean Application No. 10-2022-0118321.
Communication dated Mar. 18, 2025 in Japanese Application No. 2023-575982.

* cited by examiner

AEROSOL GENERATING DEVICE

CROSS REFERENCE TO RELATED APPLICATIONS

This application is a National Stage of International Application No. PCI/KR2023/011913 filed on Aug. 11, 2023, claiming priority based on Korean Patent Application No. 10-2022-0118321 filed on Sep. 20, 2022.

TECHNICAL FIELD

The following embodiments relate to an aerosol generating module and an aerosol generating device.

BACKGROUND ART

Recently, demands for alternative ways to overcome the disadvantages of general cigarettes have increased. For example, there is an increasing demand for devices that generate an aerosol by electrically heating a cigarette stick (e.g., cigarette-like electronic cigarettes). An ultrasonic method or a wick heating method may be used to generate an aerosol. When an ultrasonic method is used, the size of aerosol particles may not be uniform and droplets may splatter. When a wick heating method is used, an aerosol may not be generated if the wick itself is heated.

For example, KR Patent Application Publication No. 10-2017-0132823 discloses a non-combustion-type flavor inhaler, a flavor inhalation component source unit, and an atomizing unit.

The above description is information the inventor(s) acquired during the course of conceiving the present disclosure, or already possessed at the time, and was not necessarily publicly known before the present application was filed.

DISCLOSURE OF INVENTION

Technical Problem

An aspect provides a device for generating a fine aerosol of uniform size using a surface acoustic wave (SAW).

An aspect provides an aerosol generating device that evenly provides an aerosol forming substrate to prevent droplet aggregation.

Solution to Problem

According to an embodiment, an aerosol generating device may include a housing having a first surface and a second surface opposite to the first surface, a mouth side end disposed on the first surface, at least one cartridge disposed in the housing and configured to store an aerosol forming substrate, and an aerosol generator connected to the cartridge and configured to generate an aerosol, wherein the aerosol generator may include a substrate including a plate shape, at least one transducer disposed on the substrate, and an atomization region on a surface of the substrate, in which the aerosol is generated, wherein the substrate may be disposed in the housing to form an acute angle with respect to a central axis that is parallel to a longitudinal direction of the housing, the longitudinal direction being a direction from the first surface toward the second surface, and the transducer may be configured to convert an electrical signal into a surface acoustic wave (SAW), and the SAW may be transferred to the atomization region through the substrate to aerosolize the aerosol forming substrate.

In an embodiment, the cartridge may include a first reservoir disposed closed to the first surface than to a second reservoir, and the second reservoir may be disposed to be spaced apart from the first reservoir in the longitudinal direction of the housing.

In an embodiment, the second reservoir may be disposed to face the first reservoir across the aerosol generator.

In an embodiment, the aerosol forming substrate stored in the first reservoir may flow through the surface of the substrate into the second reservoir along a gravity direction.

In an embodiment, the aerosol generating device may further include a wick configured to transfer the aerosol forming substrate to the aerosol generator, wherein a first end of the wick may be connected to the first reservoir, and a second end of the wick may be connected to the aerosol generator.

In an embodiment, the second end of the wick may be disposed to overlap at least a portion of the atomization region.

In an embodiment, the aerosol generating device may further include a connecting member configured to transfer the aerosol forming substrate stored in the second reservoir to the wick, wherein an end of the connecting member may be connected to the wick, and another end of the connecting member may be connected to the second reservoir.

In an embodiment, the transducer may include a plurality of transducers, and the plurality of transducers may be disposed to face each other across the atomization region.

In an embodiment, the transducer may include a first transducer configured to transmit the SAW to the atomization region and a second transducer configured to transmit the SAW to the atomization region.

In an embodiment, the transducer may include a first transducer configured to transmit the SAW to the atomization region and a second transducer configured to receive the SAW transmitted from the first transducer.

In an embodiment, the aerosol generating device may further include a sensing unit configured to detect an internal or external state of the aerosol generating device and a controller configured to control an operation of the aerosol generating device depending on the internal or external state of the aerosol generating device detected by the sensing unit.

In an embodiment, the sensing unit may include a tilt sensor configured to detect a degree of inclination of the aerosol generating device, and the controller may be configured to adjust an angle formed by the aerosol generator with respect to the central axis according to the degree of inclination of the aerosol generating device detected by the tilt sensor.

According to another embodiment, an aerosol generating device may include a housing having a first surface and a second surface opposite to the first surface, a mouth side end disposed on the first surface, a first reservoir disposed closer to the first surface than to the second surface, and configured to store an aerosol forming substrate, a second reservoir disposed to be spaced apart from the first reservoir based on a longitudinal direction of the housing and configured to store an aerosol forming substrate, an aerosol generator connected to the first reservoir and configured to generate an aerosol, a wick configured to connect the first reservoir and the aerosol generator and transfer the aerosol forming substrate to the aerosol generator, and a connecting member configured to connect the wick and the second reservoir and transfer the aerosol forming substrate to the wick.

In an embodiment, the aerosol generator may include a substrate including a plate shape, at least one transducer disposed on the substrate, and an atomization region on a surface of the substrate, in which an aerosol is generated, wherein the transducer is configured to convert an electrical signal into an SAW, and the SAW aerosolizes the aerosol forming substrate.

In an embodiment, the substrate may be disposed in the housing to form an acute angle with respect to a central axis that is parallel to the longitudinal direction of the housing, the aerosol forming substrate stored in the first reservoir may flow through the surface of the substrate into the second reservoir along a gravity direction, and the aerosol forming substrate stored in the second reservoir may flow through the connecting member into the wick.

Advantageous Effects of Invention

An aerosol generating device according to an embodiment may generate a fine aerosol of uniform size to improve a smoke flavor.

An aerosol generating device according to an embodiment may evenly provide an aerosol forming substrate to prevent droplet aggregation.

The effects of the aerosol generating device according to an embodiment are not limited to the above-mentioned effects, and other unmentioned effects can be clearly understood from the following description by one of ordinary skill in the art.

MODE FOR THE INVENTION

Figure 1:
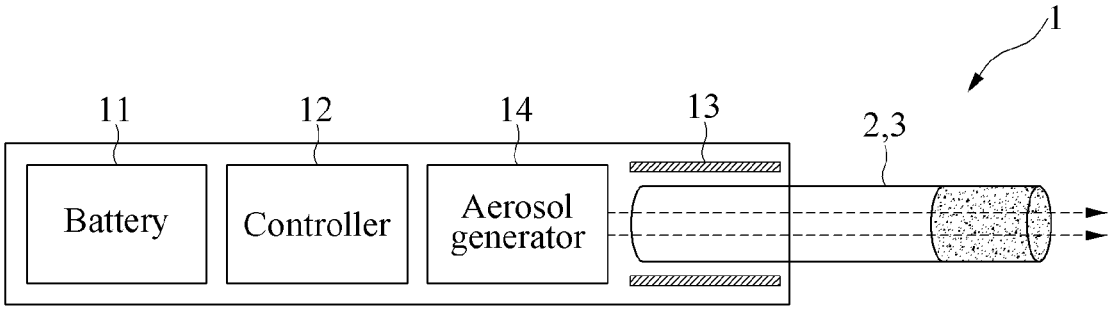
FIG. 1 is a diagram illustrating an example of a cigarette inserted into an aerosol generating device according to an embodiment.

The terms used in the embodiments are selected from among common terms that are currently widely used, in consideration of their function in the embodiments of the present disclosure. However, different terms may be used depending on an intention of one of ordinary skill in the art, a precedent, or the advent of new technology. Also, in particular cases, the terms are discretionally selected by the applicant of the disclosure, and the meaning of those terms will be described in detail in the corresponding part of the detailed description. Therefore, the terms used in the disclosure should be defined based on the meanings of the terms and all the content of the disclosure, rather than the terms themselves.

It will be understood that when a certain part "includes" a certain component, the part does not exclude another component but may further include another component, unless the context clearly dictates otherwise. Also, terms such as "unit", "module", etc., as used in the specification may refer to a part for processing at least one function or operation and may be implemented as hardware, software, or a combination of hardware and software.

Unless otherwise defined, all terms including technical and scientific terms used herein have the same meaning as commonly understood by one of ordinary skill in the art to which embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the embodiments with reference to the accompanying drawings, like reference numerals refer to like components and a repeated description related thereto will be omitted. In the description of the embodiments, detailed description of well-known related structures or functions will be omitted when it is deemed that such description will cause ambiguous interpretation of the present disclosure.

Also, terms such as first, second, A, B, (a), (b), or the like may be used to describe components of the embodiments. These terms are used only for the purpose of discriminating one component from another component, and the nature, the sequences, or the orders of the components are not limited by the terms. It is to be understood that if a component is described as being "connected," "coupled" or "joined" to another component, the former may be directly "connected," "coupled," and "joined" to the latter or "connected", "coupled", and "joined" to the latter via another component.

Components included in an embodiment and components having a common function are described using the same names in other embodiments. Unless stated otherwise, the description of an embodiment may be applicable to other embodiments, and a repeated description related thereto is omitted.

In the following embodiments, the term "aerosol generating article" may refer to an article that accommodates a medium, in which an aerosol passes through the article and the medium is transferred. A representative example of the aerosol generating article may be a cigarette. However, the scope of the disclosure is not limited thereto.

In the following embodiments, the term "upstream" or "upstream direction" may refer to a direction away from an oral region of a user (smoker), and the term "downstream" or "downstream direction" may refer to a direction approaching the oral region of the user. The terms "upstream" and "downstream" may be used to describe relative positions of components of the aerosol generating article.

In the following embodiments, the term "puff" refers to inhalation by a user, and inhalation refers to a situation in which a user draws in an aerosol into his or her oral cavity, nasal cavity, or lungs through the mouth or nose.

In an embodiment, an aerosol generating device may be a device that generates an aerosol by electrically heating a cigarette accommodated in an inner space.

The aerosol generating device may include a heater. In an embodiment, the heater may be an electrically resistive heater. For example, the heater may include an electrically conductive track, and the heater may be heated as a current flows through the electrically conductive track.

The heater may include a tubular heating element, a plate-shaped heating element, a needle-shaped heating element, or a rod-shaped heating element, and may heat an interior or exterior of the cigarette according to the shape of a heating element.

The cigarette may include a tobacco rod and a filter rod. The tobacco rod may be formed as a sheet or a strand, or may be formed of tobacco leaves finely cut from a tobacco sheet. In addition, the tobacco rod may be enveloped by a thermally conductive material. For example, the thermally conductive material may be metal foil such as aluminum foil. However, embodiments are not limited thereto.

The filter rod may be a cellulose acetate filter. The filter rod may include at least one segment. For example, the filter rod may include a first segment that cools an aerosol and a second segment that filters a predetermined ingredient contained in the aerosol.

In another embodiment, the aerosol generating device may be a device that generates an aerosol using a cartridge containing an aerosol generating material.

The aerosol generating device may include a cartridge containing the aerosol generating material and a main body supporting the cartridge. The cartridge may be detachably coupled to the main body. However, embodiments are not limited thereto. The cartridge may be integrally formed or assembled with the main body, and may be secured to the main body so as not to be detached by a user. The cartridge may be mounted on the main body while the aerosol generating material is accommodated therein. However, embodiments are not limited thereto. The aerosol generating material may be injected into the cartridge while the cartridge is coupled to the main body.

In another embodiment, the aerosol generating device may generate an aerosol by heating a liquid composition, and the generated aerosol may pass through the cigarette and be delivered to the user. That is, the aerosol generated from the liquid composition may travel along an airflow path of the aerosol generating device, and the airflow path may be configured to allow the aerosol to pass through the cigarette and be delivered to the user.

Hereinafter, embodiments of the disclosure will be described in detail with reference to the accompanying drawings such that one of ordinary skill in the art may easily practice the disclosure. The disclosure may be practiced in forms that are implementable in the aerosol generating devices according to various embodiments described above or may be embodied and practiced in many different forms and is not limited to the embodiments described herein.

Hereinafter, embodiments of the disclosure will be described in detail with reference to the drawings.

Figure 2:
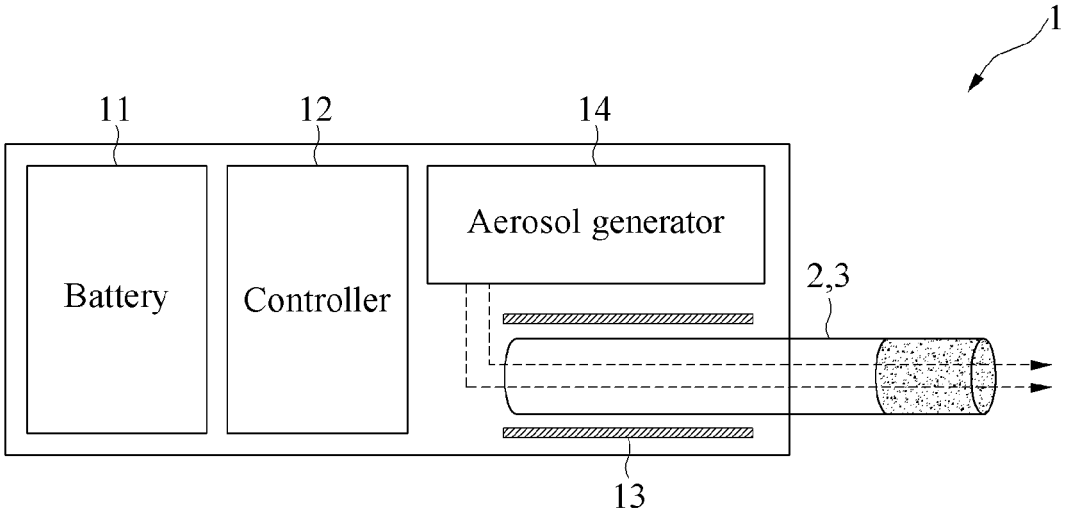
FIG. 2 is a diagram illustrating an example of a cigarette inserted into an aerosol generating device according to an embodiment.

FIGS. 1 and 2 are diagrams illustrating examples of a cigarette inserted into an aerosol generating device according to an embodiment.

Referring to FIGS. 1 and 2, an aerosol generating device 1 may further include a vaporizer 14. Further, a cigarette 2, 3 may be inserted into an inner space of the aerosol generating device 1.

In addition, although it is shown that a heater 13 is included in the aerosol generating device 1 in FIGS. 1 and 2, the heater 13 may be omitted as needed.

FIG. 1 illustrates a linear alignment of a battery 11, a controller 12, the heater 13, and the aerosol generator 14. Further, FIG. 2 illustrates a parallel alignment of the aerosol generator 14 and the heater 13. However, an internal structure of the aerosol generating device 1 is not limited to what is shown in FIGS. 1 and 2. That is, the alignments of the battery 11, the controller 12, the heater 13, and the aerosol generator 14 may be changed depending on the design of the aerosol generating device 1.

When the cigarette 2, 3 is inserted into the aerosol generating device 1, the aerosol generating device 1 may operate the heater 13 and/or the aerosol generator 14 to generate an aerosol. The aerosol generated by the heater 13 and/or the aerosol generator 14 may pass through the cigarette 2 into a user.

Even when the cigarette 2, 3 is not inserted into the aerosol generating device 1, the aerosol generating device 1 may heat the heater 13, as needed.

The battery 11 may supply power to be used to operate the aerosol generating device 1. For example, the battery 11 may supply power to heat the heater 13 or the aerosol generator 14, and may supply power required for the controller 12 to operate. In addition, the battery 11 may supply power required to operate a display, a sensor, a motor, or the like installed in the aerosol generating device 1.

The controller 12 may control the overall operation of the aerosol generating device 1. Specifically, the controller 12 may control respective operations of other components included in the aerosol generating device 1, in addition to the battery 11, the heater 13, and the aerosol generator 14. In addition, the controller 12 may verify a state of each of the components of the aerosol generating device 1 to determine whether the aerosol generating device 1 is in an operable state.

The controller 12 may include at least one processor. The processor may be implemented as an array of a plurality of logic gates, or may be implemented as a combination of a general-purpose microprocessor and a memory in which a program executable in the microprocessor is stored. In addition, it is to be understood by one of ordinary skill in the art to which the present disclosure pertains that the processor may be implemented in other types of hardware.

The heater 13 may be heated by the power supplied by the battery 11. For example, when the cigarette 2, 3 is inserted in the aerosol generating device 1, the heater 130 may be disposed outside the cigarette. The heated heater 13 may thus raise the temperature of an aerosol generating material in the cigarette.

The heater 13 may be an electrically resistive heater. For example, the heater 13 may include an electrically conductive track, and the heater 13 may be heated as a current flows through the electrically conductive track. However, the heater 13 is not limited to the foregoing example, and any example of heating the heater 13 up to a desired temperature may be applicable without limitation. Here, the desired temperature may be preset in the aerosol generating device 1 or may be set by the user.

As another example, the heater 13 may be an induction heater. Specifically, the heater 13 may include an electrically conductive coil for heating the cigarette in an induction heating manner, and the cigarette may include a susceptor to be heated by the induction heater.

For example, the heater 13 may include a tubular heating element, a plate-shaped heating element, a needle-shaped heating element, or a rod-shaped heating element, and may heat the inside or outside of the cigarette 2, 3 according to the shape of a heating element.

Figure 3:
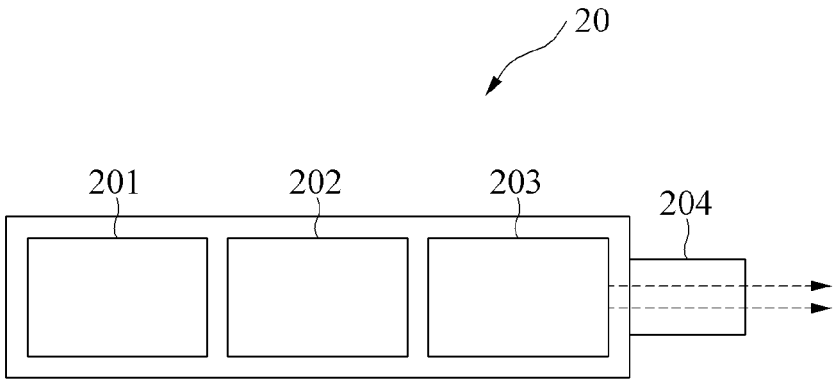
FIG. 3 is a diagram illustrating an example of a mouthpiece inserted into an aerosol generating device according to an embodiment.

In addition, the heater 13 may be provided as a plurality of heaters in the aerosol generating device 1. In this case, the plurality of heaters 13 may be disposed to be inserted into the cigarette 2, or may be disposed outside the cigarette 2, 3. In addition, some of the heaters 13 may be disposed to be inserted into the cigarette 2, 3, and the rest may be disposed outside the cigarette 2, 3. However, the shape of the heater 13 is not limited to what is shown in FIGS. 1 to 3 but may be provided in various shapes.

The aerosol generator 14 may generate an aerosol by heating a liquid composition, and the generated aerosol may pass through the cigarette 2, 3 and be delivered to the user. That is, the aerosol generated by the aerosol generator 14 may travel along an airflow path of the aerosol generating device 1, and the airflow path may be configured such that the aerosol generated by the aerosol generator 14 may pass through the cigarette 2, 3 into the user.

For example, the aerosol generator 14 may include an aerosol generator 203, a liquid transfer means, and a heating element, but embodiments are not limited thereto. For example, the aerosol generator 203, the liquid transfer means, and the heating element may be included as independent modules in the aerosol generating device 1.

The aerosol generating device 1 may further include general-purpose components in addition to the battery 11, the controller 12, the heater 13, and the aerosol generator 14. For example, the aerosol generating device 1 may include a display that outputs visual information and/or a motor that outputs tactile information. In addition, the aerosol generating device 1 may include at least one sensor (e.g., a puff sensor, a temperature sensor, a cigarette insertion detection sensor, etc.). In addition, the aerosol generating device 1 may be manufactured to have a structure allowing external air to be introduced or internal gas to flow out even while the cigarette 2, 3 is inserted.

Although not shown in FIGS. 1 to 3, the aerosol generating device 1 may constitute a system along with a separate cradle. For example, the cradle may be used to charge the battery 11 of the aerosol generating device 1. Alternatively, the cradle may be used to heat the heater 13, with the cradle and the aerosol generating device 1 coupled.

The cigarette 2, 3 may be similar to a general combustible cigarette. For example, the cigarette 2, 3 may be divided into a first portion including an aerosol generating material and a second portion including a filter or the like. Alternatively, the second portion of the cigarette 2, 3 may also include the aerosol generating material. For example, the aerosol generating material provided in the form of granules or capsules may be inserted into the second portion.

The first portion may be entirely inserted into the aerosol generating device 1, and the second portion may be exposed outside. Alternatively, only the first portion may be partially inserted into the aerosol generating device 1, or the first portion may be entirely inserted into the aerosol generating device 1 and the second portion may be partially inserted into the aerosol generating device 1. The user may inhale an aerosol with the second portion in a mouth of the user. In this case, an aerosol may be generated as external air passes through the first portion, and the generated aerosol may pass through the second portion into the mouth of the user.

For example, the external air may be introduced through at least one air path formed in the aerosol generating device 1. In this example, opening or closing and/or the size of the air path formed in the aerosol generating device 1 may be adjusted by the user. Accordingly, an amount of atomization, a sense of smoking, or the like may be adjusted by the user. As another example, the external air may be introduced into the inside of the cigarette 2, 3 through at least one hole formed on a surface of the cigarette 2, 3.

FIG. 3 is a diagram illustrating an example of a mouthpiece inserted into an aerosol generating device according to an embodiment. Any repeated description related to the descriptions provided with reference to FIGS. 1 and 2 is not included herein.

Referring to FIG. 3, an aerosol generating device 20 according to an embodiment may include a battery 201, a controller 202, the aerosol generator 203, and a mouthpiece 204. The aerosol generator 203 according to an embodiment may store a liquid composition. The liquid composition may be, for example, a liquid including a tobacco-containing material that includes a volatile tobacco flavor component, or may be a liquid including a non-tobacco material. The aerosol generator 203 may be manufactured to be detachable and attachable from and to the aerosol generating device 20, or may be manufactured integrally with the aerosol generating device 20.

The liquid composition may include, for example, water, a solvent, ethanol, a plant extract, a fragrance, a flavoring agent, or a vitamin mixture. The fragrance may include, for example, menthol, peppermint, spearmint oil, various fruit-flavored ingredients, and the like, but is not limited thereto. The flavoring agent may include ingredients that provide a user with a variety of flavors or scents. The vitamin mixture may be a mixture of at least one of vitamin A, vitamin B, vitamin C, or vitamin E, but is not limited thereto. The liquid composition may also include an aerosol former such as glycerin and propylene glycol.

The liquid transfer means may transfer the liquid composition in the aerosol generator 203 to a heating element. The liquid transfer means may be, for example, a wick such as cotton fiber, ceramic fiber, glass fiber, or porous ceramic, but is not limited thereto.

The heating element may be an element for heating the liquid composition transferred by the liquid transfer means. The heating element may be, for example, a metal heating wire, a metal heating plate, a ceramic heater, or the like, but is not limited thereto. In addition, the heating element may include a conductive filament such as a nichrome wire, and may be arranged in a structure wound around the liquid transfer means. The heating element may be heated as a current is supplied and may transfer heat to the liquid composition in contact with the heating element, and may thereby heat the liquid composition. As a result, an aerosol may be generated.

For example, the aerosol generator 14, 203 may also be referred to as an atomizer or a cartomizer, but is not limited thereto.

Hereinafter, examples of the cigarette 2, 3 will be described with reference to FIGS. 4 and 5.

Figure 4:
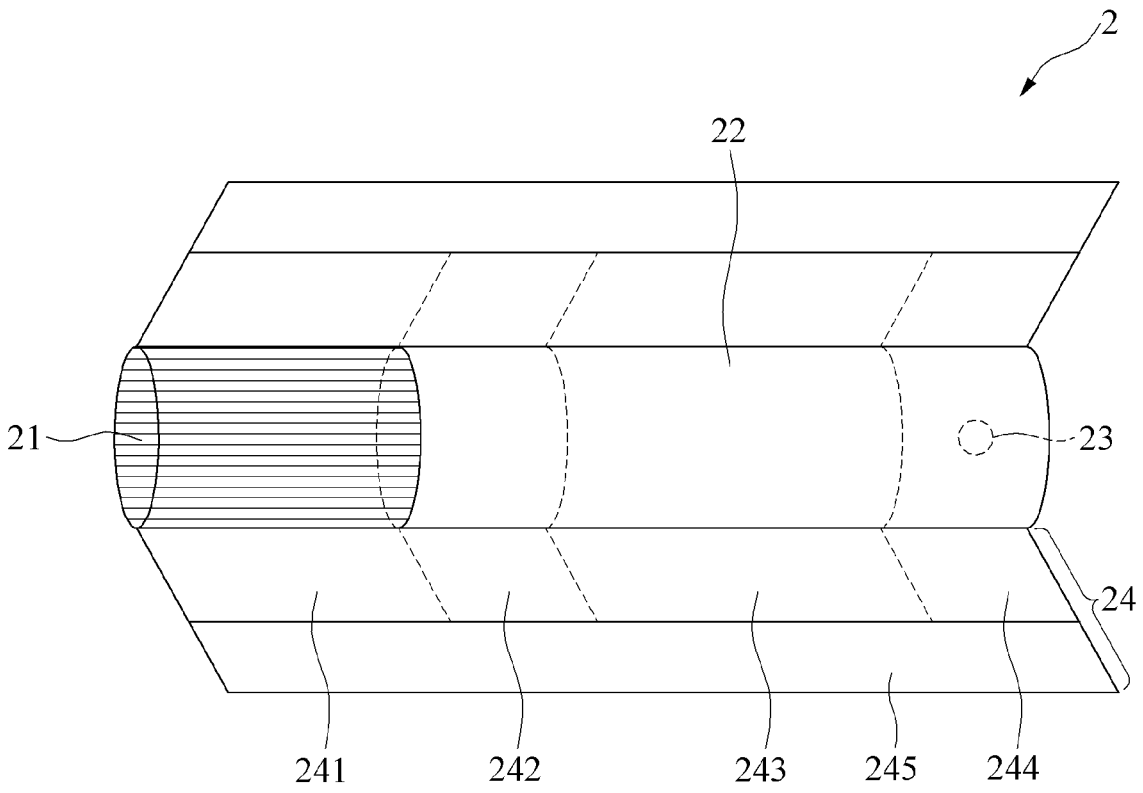
FIG. 4 is a diagram illustrating an example of a cigarette according to an embodiment.
Figure 5:
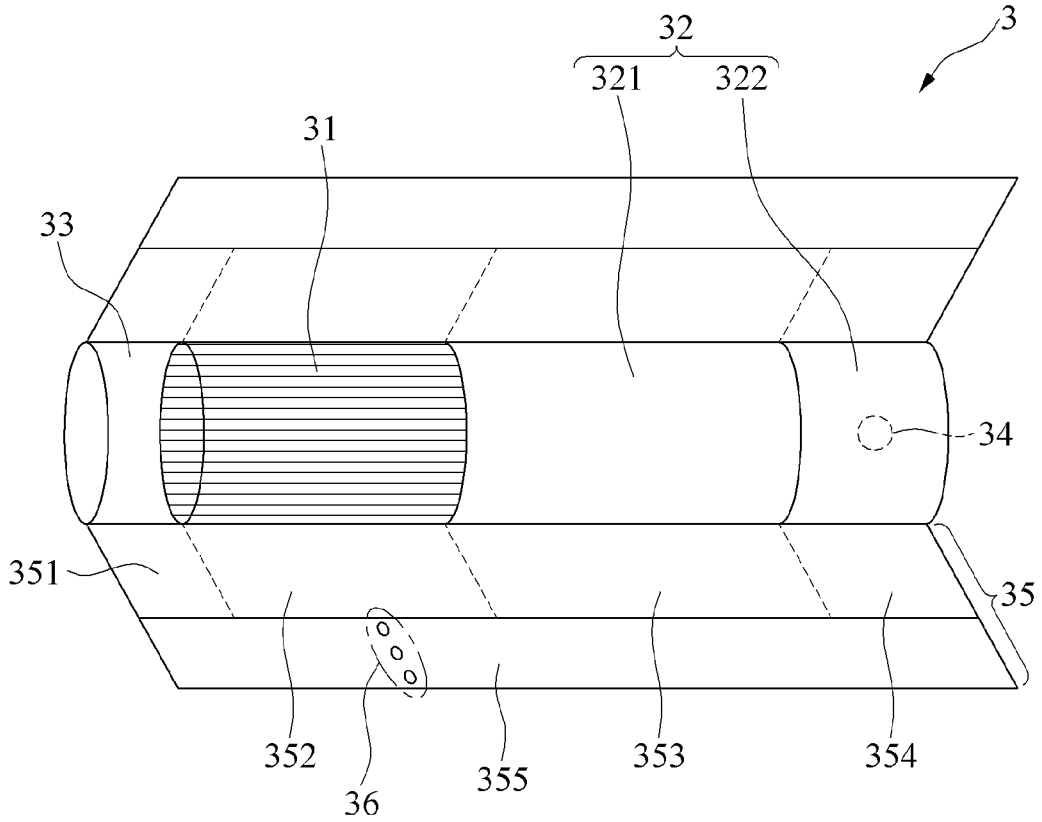
FIG. 5 is a diagram illustrating an example of a cigarette according to an embodiment.

FIGS. 4 and 5 are diagrams illustrating examples of a cigarette according to an embodiment.

Referring to FIG. 4, the cigarette 2 may include a tobacco rod 21 and a filter rod 22. The first portion and the second portion described above with reference to FIGS. 1 to 3 may include the tobacco rod 21 and the filter rod 22, respectively.

The filter rod 22 may have a single segment or a plurality of segments as illustrated in FIG. 4, but embodiments are not limited thereto. The plurality of segments of the filter rod 22 may include a segment that cools an aerosol and a segment that filters a predetermined ingredient contained in an aerosol. In addition, the filter rod 22 may further include at least one segment that performs another function, as needed. For example, as shown FIG. 4, the filter rod 22 may include a first segment abutting the tobacco rod 21, a second segment abutting the downstream end of the first segment, and a third segment abutting the downstream end of the second segment.

A diameter of the cigarette 2 may be in a range of 5 millimeters (mm) to 9 mm, and a length thereof may be about 48 mm. However, embodiments are not limited thereto. For example, a length of the tobacco rod 21 may be about 12 mm, a length of a first segment of the filter rod 22 may be about 10 mm, a length of a second segment of the filter rod 22 may be about 14 mm, and a length of a third segment of the filter rod 22 may be about 12 mm. However, embodiments are not limited thereto.

The cigarette 2 may be wrapped with at least one wrapper 24. The wrapper 24 may have at least one hole through which external air is introduced or internal gas flows out. For example, the cigarette 2 may be wrapped with one wrapper 24. As another example, the cigarette 2 may be wrapped with two or more wrappers 24 in an overlapping manner. For example, the tobacco rod 21 may be wrapped with a first wrapper 241, and the filter rod 22 may be wrapped with wrappers 242, 243, and 244. In addition, the cigarette 2 may be entirely wrapped again with a single wrapper 245. When the filter rod 22 includes a plurality of segments, the plurality of segments may be wrapped with the wrappers 242, 243, and 244, respectively.

The first wrapper 241 and the second wrapper 242 may be formed of general filter wrapping paper. For example, the first wrapper 241 and the second wrapper 242 may be porous wrapping paper or non-porous wrapping paper. In addition, the first wrapper 241 and the second wrapper 242 may be formed of oilproof paper and/or an aluminum laminated wrapping material.

The third wrapper 243 may be formed of hard wrapping paper. For example, a basis weight of the third wrapper 243 may be in a range of 88 grams per square meter ($g/m^2$) to 96 $g/m^2$, and desirably, may be in a range of 90 $g/m^2$ to 94 $g/m^2$. In addition, a thickness of the third wrapper 243 may be in a range of 120 micrometers (μm) to 130 μm, and desirably, may be 125 μm.

The fourth wrapper 244 may be formed of oilproof hard wrapping paper. For example, a basis weight of the fourth wrapper 244 may be in a range of 88 $g/m^2$ to 96 $g/m^2$, and desirably, may be in a range of 90 $g/m^2$ to 94 $g/m^2$. In addition, a thickness of the fourth wrapper 244 may be in a range of 120 μm to 130 μm, and desirably, may be 125 μm.

The fifth wrapper 245 may be formed of sterile paper (e.g., MFW). Here, the sterile paper (MFW) may refer to paper specially prepared such that it has enhanced tensile strength, water resistance, smoothness, or the like, compared to general paper. For example, a basis weight of the fifth wrapper 245 may be in a range of 57 $g/m^2$ to 63 $g/m^2$, and desirably, may be 60 $g/m^2$. In addition, a thickness of the fifth wrapper 245 may be in a range of 64 μm to 70 μm, and desirably, may be 67 μm.

The fifth wrapper 245 may have a predetermined material internally added thereto. The material may be, for example, silicon. However, embodiments are not limited thereto. Silicon may have properties, such as, for example, heat resistance which is characterized by less change by temperature, oxidation resistance which refers to resistance to oxidation, resistance to various chemicals, water repellency against water, or electrical insulation. However, silicon may not necessarily be used, and any material having such properties described above may be applied to (or used to coat) the fifth wrapper 245 without limitation.

The fifth wrapper 245 may prevent the cigarette 2 from burning. For example, there may be a probability that the cigarette 2 burns when the tobacco rod 21 is heated by the heater 13. For example, when the temperature rises above an ignition point of any one of materials included in the tobacco rod 21, the cigarette 2 may burn. Even in this example, it may still be possible to prevent the cigarette 2 from burning because the fifth wrapper 245 includes a non-combustible material.

In addition, the fifth wrapper 245 may prevent a holder from being contaminated by substances produced in the cigarette 2. For example, liquid substances may be produced in the cigarette 2 when a user puffs. For example, as an aerosol generated in the cigarette 2 is cooled by external air, such liquid substances (e.g., water, etc.) may be produced. Thus, wrapping the cigarette 2 with the fifth wrapper 245 may prevent the liquid substances produced in the cigarette 2 from leaking out of the cigarette 2.

The tobacco rod 21 may include an aerosol generating material. The aerosol generating material may include, for example, at least one of glycerin, propylene glycol, ethylene glycol, dipropylene glycol, diethylene glycol, triethylene glycol, tetraethylene glycol, or oleyl alcohol. However, embodiments are not limited thereto. The tobacco rod 21 may also include other additives, such as, for example, a flavoring agent, a wetting agent, and/or an organic acid. In addition, the tobacco rod 21 may include a flavoring liquid such as menthol or a moisturizing agent that is added as being sprayed onto the tobacco rod 21.

The tobacco rod 21 may be manufactured in various forms. For example, the tobacco rod 21 may be manufactured as a sheet or as a strand. The tobacco rod 21 may also be formed of tobacco leaves finely cut from a tobacco sheet. In addition, the tobacco rod 21 may be enveloped by a thermally conductive material. The heat-conductive material may be, for example, a metal foil such as an aluminum foil, but is not limited thereto For example, the thermally conductive material enveloping the tobacco rod 21 may evenly distribute the heat transferred to the tobacco rod 21 to improve the thermal conductivity to be applied to the tobacco rod 21, thereby improving the taste of tobacco. In addition, the thermally conductive material enveloping the tobacco rod 21 may function as a susceptor heated by an induction heater. In this case, although not shown, the tobacco rod 21 may further include an additional susceptor in addition to the thermally conductive material enveloping the outside thereof.

The filter rod 22 may be a cellulose acetate filter. However, a shape of the filter rod 22 is not limited. For example, the filter rod 22 may be a cylindrical rod or a tubular rod including a hollow therein. The filter rod 22 may also be a recess-type rod. For example, when the filter rod 22 includes a plurality of segments, at least one of the segments may be manufactured in a different shape.

The first segment of the filter rod 22 may be a cellulose acetate filter. For example, the first segment may be a tubular structure including a hollow therein. In this example, the first segment may prevent internal materials of the tobacco rod 21 from being pushed back when the heater 13 is inserted and generate an aerosol cooling effect. A desirable diameter of the hollow included in the first segment may be adopted from a range of 2 mm to 4.5 mm. However, embodiments are not limited thereto.

A desirable length of the first segment may be adopted from a range of 4 mm to 30 mm, but is not limited thereto. Desirably, the length of the first segment may be 10 mm, but is not limited thereto.

The first segment may have a hardness that is adjustable through an adjustment of the content of a plasticizer in a process of manufacturing the first segment. In addition, the first segment may be manufactured by inserting a structure such as a film or a tube of the same or different materials inside (e.g., the hollow).

A second segment of the filter rod 22 may cool an aerosol generated as the heater 13 heats the tobacco rod 21. The user may thus inhale the aerosol cooled down to a suitable temperature.

A length or diameter of the second segment may be determined in various ways according to the shape of the cigarette 2. For example, a length of the second segment may be properly adopted from a range of from 7 mm to 20 mm. Desirably, the length of the second segment may be about 14 mm. However, embodiments are not limited thereto.

The second segment may be manufactured by weaving a polymer fiber. In this case, a flavoring liquid may be applied to a fiber formed of a polymer. Alternatively, the second segment may be manufactured by weaving a separate fiber to which a flavoring liquid is applied and the fiber formed of the polymer together. Alternatively, the second segment may be formed of a crimped polymer sheet.

For example, the polymer may be prepared with a material selected from the group consisting of polyethylene (PE), polypropylene (PP), polyvinyl chloride (PVC), polyethylene terephthalate (PET), polylactic acid (PLA), cellulose acetate (CA), and aluminum foil.

As the second segment is formed of the woven polymer fiber or the crimped polymer sheet, the second segment may include a single channel or a plurality of channels extending in a longitudinal direction. A channel used herein may refer to a path through which a gas (e.g., air or aerosol) passes.

For example, the second segment made of the crimped polymer sheet may be formed of a material having a thickness between about 5 μm and about 300 μm, for example, between about 10 μm and about 250 μm. In addition, a total surface area of the second segment may be between about 300 square millimeters per millimeter ($mm^2$/mm) and about 1000 $mm^2$/mm. Further, an aerosol cooling element may be formed from a material having a specific surface area between about 10 square millimeters per milligram ($mm^2$/mg) and about 100 $mm^2$/mg.

The second segment may include a thread containing a volatile flavor ingredient. The volatile flavor ingredient may be menthol, but is not limited thereto. For example, the thread may be filled with an amount of menthol sufficient to provide at least 1.5 mg of menthol to the second segment.

A third segment of the filter rod 22 may be a cellulose acetate filter. A length of the third segment may be properly adopted within a range of from 4 mm to 20 mm. For example, the length of the third segment may be about 12 mm, but is not limited thereto.

The third segment may be manufactured such that a flavor is generated by spraying a flavoring liquid onto the third segment in a process of manufacturing the third segment. Alternatively, a separate fiber to which the flavoring liquid is applied may be inserted into the third segment. An aerosol generated in the tobacco rod 21 may be cooled as it passes through the second segment of the filter rod 22, and the cooled aerosol may pass through the third segment into the user. Accordingly, when a flavoring element is added to the third segment, the durability of the flavor to be carried to the user may be enhanced.

In addition, the filter rod 22 may include at least one capsule 23. The capsule 23 may perform a function of generating a flavor, or a function of generating an aerosol. For example, the capsule 23 may be of a structure in which a liquid containing a fragrance is wrapped with a film. The capsule 23 may have a spherical or cylindrical shape, but is not limited thereto.

Referring to FIG. 5, the cigarette 3 may further include a front end plug 33. The front end plug 33 may be disposed on one side of a tobacco rod 31 opposite to a filter rod 32. The front end plug 33 may prevent the tobacco rod 31 from falling off, and may also prevent an aerosol liquefied in the tobacco rod 31 during smoking from flowing into an aerosol generating device (e.g., the aerosol generating device 1 of FIGS. 1 to 3).

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

A diameter and a total length of the cigarette 3 may correspond to the diameter and the total length of the cigarette 2 of FIG. 4. For example, a length of the front end plug 33 may be about 7 mm, a length of the tobacco rod 31 may be about 15 mm, a length of the first segment 321 may be about 12 mm, and a length of the second segment 322 may be about 14 mm. However, embodiments are not limited thereto.

The cigarette 3 may be wrapped with at least one wrapper 35. The wrapper 35 may have at least one hole through which external air is introduced or internal gas flows out. For example, the front end plug 33 may be wrapped with a first wrapper 351, the tobacco rod 31 may be wrapped with a second wrapper 352, the first segment 321 may be wrapped with a third wrapper 353, and the second segment 322 may be wrapped with a fourth wrapper 354. In addition, the cigarette 3 may be entirely wrapped again with a fifth wrapper 355.

Further, at least one perforation 36 may be formed in the fifth wrapper 355. For example, the perforation 36 may be formed in an area surrounding the tobacco rod 31. However, embodiments are not limited thereto. The perforation 36 may perform a function of transferring heat generated by the heater 13 shown in FIGS. 2 and 3 to the inside of the tobacco rod 31.

In addition, the second segment 322 may include at least one capsule 34. The capsule 34 may perform a function of generating a flavor or a function of generating an aerosol. For example, the capsule 34 may have a structure in which a liquid containing a fragrance is wrapped with a film. The capsule 34 may have a spherical or cylindrical shape, but is not limited thereto.

The first wrapper 351 may be a combination of general filter wrapping paper and metal foil such as aluminum foil. For example, a total thickness of the first wrapper 351 may be in a range of 45 μm to 55 μm, and desirably, may be 50.3 μm. A thickness of the metal foil of the first wrapper 351 may be in a range of 6 μm to 7 μm, and desirably, may be 6.3 μm. A basis weight of the first wrapper 351 may be in a range of 50 $g/m^2$ to 55 $g/m^2$, and desirably, may be 53 $g/m^2$.

The second wrapper 352 and the third wrapper 353 may be formed with general filter wrapping paper. For example, the second wrapper 352 and the third wrapper 353 may be porous wrapping paper or non-porous wrapping paper.

For example, the porosity of the second wrapper 352 may be 35000 CU. However, embodiments are not limited thereto. A thickness of the second wrapper 352 may be in a range of 70 μm to 80 μm, and desirably, may be 78 μm. A basis weight of the second wrapper 352 may be in a range of 20 g/m$^2$ to 25 g/m$^2$, and desirably, may be 23.5 g/m$^2$.

For example, the porosity of the third wrapper 353 may be 24000 CU. However, embodiments are not limited thereto. A thickness of the third wrapper 353 may be in a range of 60 μm to 70 μm, and desirably, may be 68 μm. A basis weight of the third wrapper 353 may be in a range of 20 g/m$^2$ to 25 g/m$^2$, and desirably, may be 21 g/m$^2$.

The fourth wrapper 354 may be formed with PLA laminated paper. The PLA laminated paper may refer to three-ply paper including a paper layer, a PLA layer, and a paper layer. For example, a thickness of the fourth wrapper 354 may be in a range of 100 μm to 120 μm, and desirably, may be 110 μm. A basis weight of the fourth wrapper 354 may be in a range of 80 g/m$^2$ to 100 g/m$^2$, and desirably, may be 88 g/m$^2$.

The fifth wrapper 355 may be formed of sterile paper (e.g., MFW). Here, the sterilized paper (MFW) may refer to paper specially prepared to enhance tensile strength, water resistance, smoothness, or the like, compared to general paper. For example, a basis weight of the fifth wrapper 355 may be in a range of 57 g/m$^2$ to 63 g/m$^2$, and desirably, may be 60 g/m$^2$. A thickness of the fifth wrapper 355 may be in a range of 64 μm to 70 μm, and desirably, may be 67 μm.

The fifth wrapper 355 may have a predetermined material internally added thereto. The predetermined material may be, for example, silicon. However, embodiments are not limited thereto. Silicon may have properties, such as, for example, heat resistance with less change by temperature, oxidation resistance which refers to resistance to oxidation, resistance to various chemicals, water repellency against water, or electrical insulation. However, silicon may not necessarily be used, and any material having such properties described above may be applied to (or used to coat) the fifth wrapper 355 without limitation.

The front end plug 33 may be formed of cellulose acetate. For example, the front end plug 33 may be manufactured by adding a plasticizer (e.g., triacetin) to cellulose acetate tow. A mono denier of a filament constituting the cellulose acetate tow may be in a range of 1.0 to 10.0, and desirably, may be in a range of 4.0 to 6.0. The mono denier of the filament of the front end plug 33 may be more desirably 5.0. In addition, a cross-section of the filament constituting the front end plug 33 may be Y-shaped. A total denier of the front end plug 33 may be in a range of 20000 to 30000, and desirably, may be in a range of 25000 to 30000. The total denier of the front end plug 33 may be more desirably 28000.

In addition, as needed, the front end plug 33 may include at least one channel, and a cross-sectional shape of the channel may be provided in various ways.

The tobacco rod 31 may correspond to the tobacco rod 21 described above with reference to FIG. 4. Thus, a further description of the tobacco rod 31 will be omitted herein.

The first segment 321 may be formed of cellulose acetate. For example, the first segment may be a tubular structure including a hollow therein. The first segment 321 may be manufactured by adding a plasticizer (e.g., triacetin) to cellulose acetate tow. For example, a mono denier and a total denier of the first segment 321 may be the same as the mono denier and the total denier of the front end plug 33.

The second segment 322 may be formed of cellulose acetate. A mono denier of a filament of the second segment 322 may be in a range of 1.0 to 10.0, and desirably, may be in a range of 8.0 to 10.0. The mono denier of the filament of the second segment 322 may be more desirably 9.0. In addition, a cross section of the filament of the second segment 322 may be Y-shaped. A total denier of the second segment 322 may be in a range of 20000 to 30000, and desirably, may be 25000.

Figure 6:
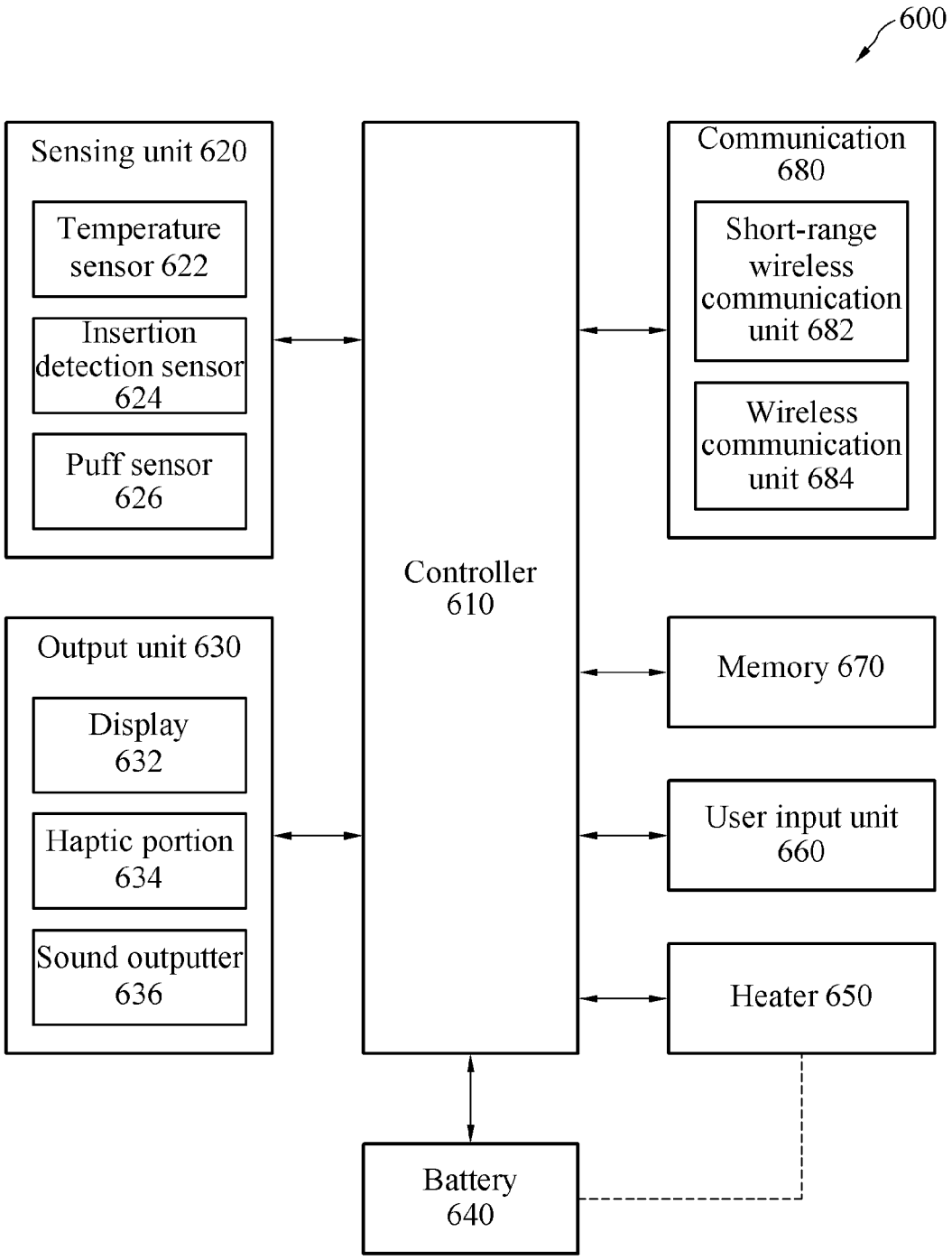
FIG. 6 is a block diagram of an aerosol generating device according to an embodiment.

FIG. 6 is a block diagram of an aerosol generating device according to various embodiments.

An aerosol generating device 600 may include a controller 610, a sensing unit 620, an output unit 630, a battery 640, a heater 650, a user input unit 660, a memory 670, and a communication unit 680. However, an internal structure of the aerosol generating device 600 is not limited to what is shown in FIG. 1. It is to be understood by one of ordinary skill in the art to which the disclosure pertains that some of the components shown in FIG. 1 may be omitted or new components may be added according to the design of the aerosol generating device 600.

The sensing unit 620 may sense a state of the aerosol generating device 600 or a state of an environment around the aerosol generating device 600, and transmit sensing information obtained through the sensing to the controller 610. Based on the sensing information, the controller 610 may control the aerosol generating device 600 to control operations of the heater 650, restrict smoking, determine whether an aerosol generating article (e.g., an aerosol generating article, a cartridge, etc.) is inserted, display a notification, and perform other functions.

The sensing unit 620 may include at least one of a temperature sensor 622, an insertion detection sensor 624, or a puff sensor 626. However, embodiments are not limited thereto.

The temperature sensor 622 may sense a temperature at which the heater 650 (or an aerosol generating material) is heated. The aerosol generating device 600 may include a separate temperature sensor for sensing the temperature of the heater 650, or the heater 650 itself may perform a function as a temperature sensor. Alternatively, the temperature sensor 622 may be arranged around the battery 640 to monitor a temperature of the battery 640.

The insertion detection sensor 624 may sense whether the aerosol generating article is inserted and/or removed. The insertion detection sensor 624 may include, for example, at least one of a film sensor, a pressure sensor, a light sensor, a resistive sensor, a capacitive sensor, an inductive sensor, or an infrared sensor, which may sense a signal change by the insertion and/or removal of the aerosol generating article.

The puff sensor 626 may sense a puff from a user based on various physical changes in an airflow path or airflow channel. For example, the puff sensor 626 may sense the puff from the user based on any one of a temperature change, a flow change, a voltage change, and a pressure change.

The sensing unit 620 may further include at least one of a temperature/humidity sensor, an atmospheric pressure sensor, a magnetic sensor, an acceleration sensor, a gyroscope sensor, a position sensor (e.g., a global positioning system (GPS)), a proximity sensor, or a red, green, blue (RGB) sensor (e.g., an illuminance sensor), in addition to the sensors 622 to 626 described above. A function of each sensor may be intuitively inferable from its name by one of ordinary skill in the art, and thus, a detailed description thereof will be omitted here.

The output unit 630 may output information about the state of the aerosol generating device 600 and provide the information to the user. The output unit 630 may include at least one of a display 632, a haptic portion 634, or a sound outputter 636. However, embodiments are not limited thereto. When the display 632 and a touchpad are provided in a layered structure to form a touchscreen, the display 632 may be used as an input device in addition to an output device.

The display 632 may visually provide information about the aerosol generating device 600 to the user. The information about the aerosol generating device 600 may include, for example, a charging/discharging state of the battery 640 of the aerosol generating device 600, a preheating state of the heater 650, an insertion/removal state of the aerosol generating article, a limited usage state (e.g., an abnormal article detected) of the aerosol generating device 600, or the like, and the display 632 may externally output the information. The display 632 may be, for example, a liquid-crystal display panel (LCD), an organic light-emitting display panel (OLED), or the like. The display 632 may also be in the form of a light-emitting diode (LED) device.

The haptic portion 634 may provide information about the aerosol generating device 600 to the user in a haptic way by converting an electrical signal into a mechanical stimulus or an electrical stimulus. The haptic portion 634 may include, for example, a motor, a piezoelectric element, or an electrical stimulation device.

The sound outputter 636 may provide information about the aerosol generating device 600 to the user in an auditory way. For example, the sound outputter 636 may convert an electrical signal into a sound signal and externally output the sound signal.

The battery 640 may supply power to be used to operate the aerosol generating device 600. The battery 640 may supply power to heat the heater 650. In addition, the battery 640 may supply power required for operations of the other components (e.g., the sensing unit 620, the output unit 630, the user input unit 660, the memory 670, and the communication unit 680) included in the aerosol generating device 600. The battery 640 may be a rechargeable battery or a disposable battery. The battery 640 may be, for example, a lithium polymer (LiPoly) battery. However, embodiments are not limited thereto.

The heater 650 may receive power from the battery 640 to heat the aerosol generating material. Although not shown in FIG. 1, the aerosol generating device 600 may further include a power conversion circuit (e.g., a direct current (DC)-to-DC (DC/DC) converter) that converts power of the battery 640 and supplies the power to the heater 650. In addition, when the aerosol generating device 600 generates an aerosol in an induction heating manner, the aerosol generating device 600 may further include a DC-to-alternating current (AC) (DC/AC) converter that converts DC power of the battery 640 into AC power.

The controller 610, the sensing unit 620, the output unit 630, the user input unit 660, the memory 670, and the communication unit 680 may receive power from the battery 640 to perform functions. Although not shown in FIG. 1, the aerosol generating device 600 may further include a power conversion circuit, for example, a low dropout (LDO) circuit or a voltage regulator circuit, which converts power of the battery 640 and supplies the power to respective components.

In an embodiment, the heater 650 may be formed of a predetermined electrically resistive material that is suitable. For example, the electrically resistive material may be a metal or a metal alloy including, for example, titanium, zirconium, tantalum, platinum, nickel, cobalt, chromium, hafnium, niobium, molybdenum, tungsten, tin, gallium, manganese, iron, copper, stainless steel, nichrome, or the like. However, embodiments are not limited thereto. In addition, the heater 650 may be implemented as a metal heating wire, a metal heating plate on which an electrically conductive track is arranged, a ceramic heating element, or the like, but is not limited thereto.

In another embodiment, the heater 650 may be an induction heater. For example, the heater 650 may include a susceptor that heats the aerosol generating material by generating heat through a magnetic field applied by a coil.

In an embodiment, the heater 650 may include a plurality of heaters. For example, the heater 650 may include a first heater for heating the aerosol generating article and a second heater for heating a liquid.

The user input unit 660 may receive information input from the user or may output information to the user. For example, the user input unit 660 may include a keypad, a dome switch, a touchpad (e.g., a contact capacitive type, a pressure resistive film type, an infrared sensing type, a surface ultrasonic conduction type, an integral tension measurement type, a piezo effect method, etc.), a jog wheel, a jog switch, or the like. However, embodiments are not limited thereto. In addition, although not shown in FIG. 1, the aerosol generating device 600 may further include a connection interface such as a universal serial bus (USB) interface, and may be connected to another external device through the connection interface such as a USB interface to transmit and receive information or to charge the battery 640.

The memory 670, which is hardware for storing various pieces of data processed in the aerosol generating device 600, may store data processed by the controller 610 and data to be processed by the controller 610. The memory 670 may include at least one type of storage medium of a flash memory type memory, a hard disk type memory, a multimedia card micro type memory, a card type memory (e.g., an SD or XD memory), a random access memory (RAM), a static random access memory (SRAM), a read-only memory (ROM), an electrically erasable programmable read-only memory (EEPROM), a programmable read-only memory (PROM), a magnetic memory, a magnetic disk, or an optical disk. The memory 670 may store an operating time of the aerosol generating device 600, a maximum number of puffs, a current number of puffs, at least one temperature profile, data associated with a smoking pattern of the user, or the like.

The communication unit 680 may include at least one component for communicating with another electronic device. For example, the communication unit 680 may include a short-range wireless communication unit 682 and a wireless communication unit 684.

The short-range wireless communication unit 682 may include a Bluetooth communication unit, a Bluetooth low energy (BLE) communication unit, a near field communication unit, a wireless area network (WLAN) (wireless fidelity (Wi-Fi)) communication unit, a ZigBee communication unit, an infrared data association (IrDA) communication unit, a Wi-Fi direct (WFD) communication unit, an ultra-wideband (UWB) communication unit, and an Ant+ communication unit. However, embodiments are not limited thereto.

The wireless communication unit 684 may include, for example, a cellular network communication unit, an Internet communication unit, a computer network (e.g., a local area network (LAN) or a wide-area network (WAN)) communication unit, or the like. However, embodiments are not limited thereto. The wireless communication unit 684 may use subscriber information (e.g., international mobile subscriber identity (IMSI)) to identify and authenticate the aerosol generating device 600 in a communication network.

The controller 610 may control the overall operation of the aerosol generating device 600. In an embodiment, the controller 610 may include at least one processor. The processor may be implemented as an array of a plurality of logic gates, or may be implemented as a combination of a general-purpose microprocessor and a memory in which a program executable by the microprocessor is stored. In addition, it is to be understood by one of ordinary skill in the art to which the disclosure pertains that it may be implemented in other types of hardware.

The controller 610 may control the temperature of the heater 650 by controlling supply of power from the battery 640 to the heater 650. For example, the controller 610 may control the supply of power by controlling switching of a switching element between the battery 640 and the heater 650. As another example, a direct heating circuit may control the supply of power to the heater 650 according to a control command from the controller 610.

The controller 610 may analyze a sensing result obtained by the sensing of the sensing unit 620 and control processes to be performed thereafter. For example, the controller 610 may control power to be supplied to the heater 650 to start or end an operation of the heater 650 based on the sensing result obtained by the sensing unit 620. As another example, the controller 610 may control an amount of power to be supplied to the heater 650 and a time for which the power is to be supplied such that the heater 650 may be heated up to a predetermined temperature or maintained at a desired temperature, based on the sensing result obtained by the sensing unit 620.

The controller 610 may control the output unit 630 based on the sensing result obtained by the sensing unit 620. For example, when the number of puffs counted through the puff sensor 626 reaches a preset number, the controller 610 may inform the user that the aerosol generating device 600 is to be ended soon, through at least one of the display 632, the haptic portion 634, or the sound outputter 636.

In an embodiment, the controller 610 may control a power supply time and/or a power supply amount for the heater 650 according to a state of the aerosol generating article sensed by the sensing unit 620. For example, when the aerosol generating article is in an over-humidified state, the controller 610 may control the power supply time for an inductive coil to increase a preheating time, compared to a case where the aerosol generating article is in a general state.

An embodiment may be implemented in the form of a recording medium including instructions executable by a computer, such as a program module executable by the computer. A computer-readable medium may be any available medium that may be accessed by a computer and includes a volatile medium, a non-volatile medium, a removable medium, and a non-removable medium. In addition, the computer-readable medium may include both a computer storage medium and a communication medium. The computer storage medium includes all of a volatile medium, a non-volatile medium, a removable medium, and a non-removable medium implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer medium.

Figure 7:
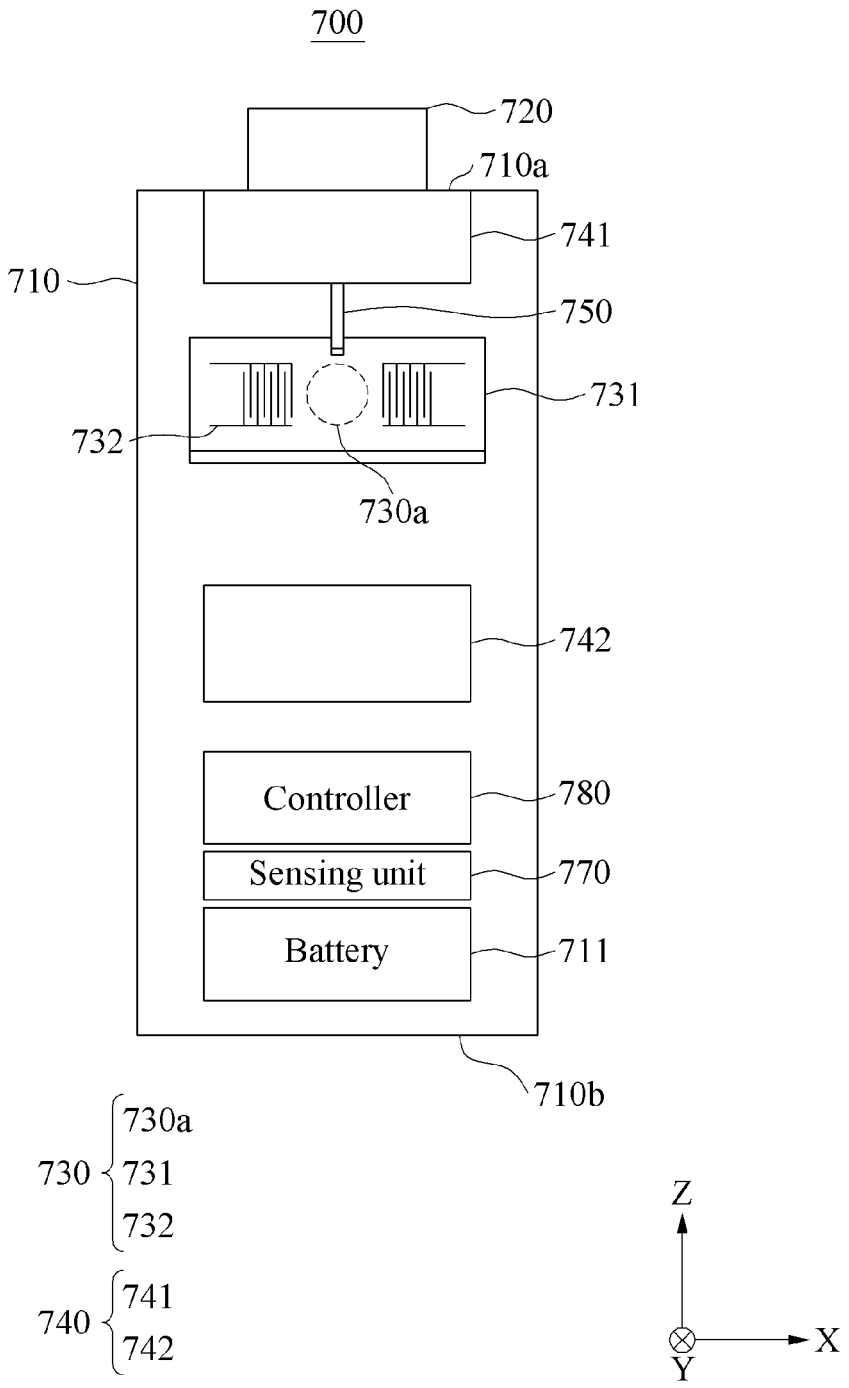
FIG. 7 is a front view of an aerosol generating device showing its internal components according to an embodiment.
Figure 8:
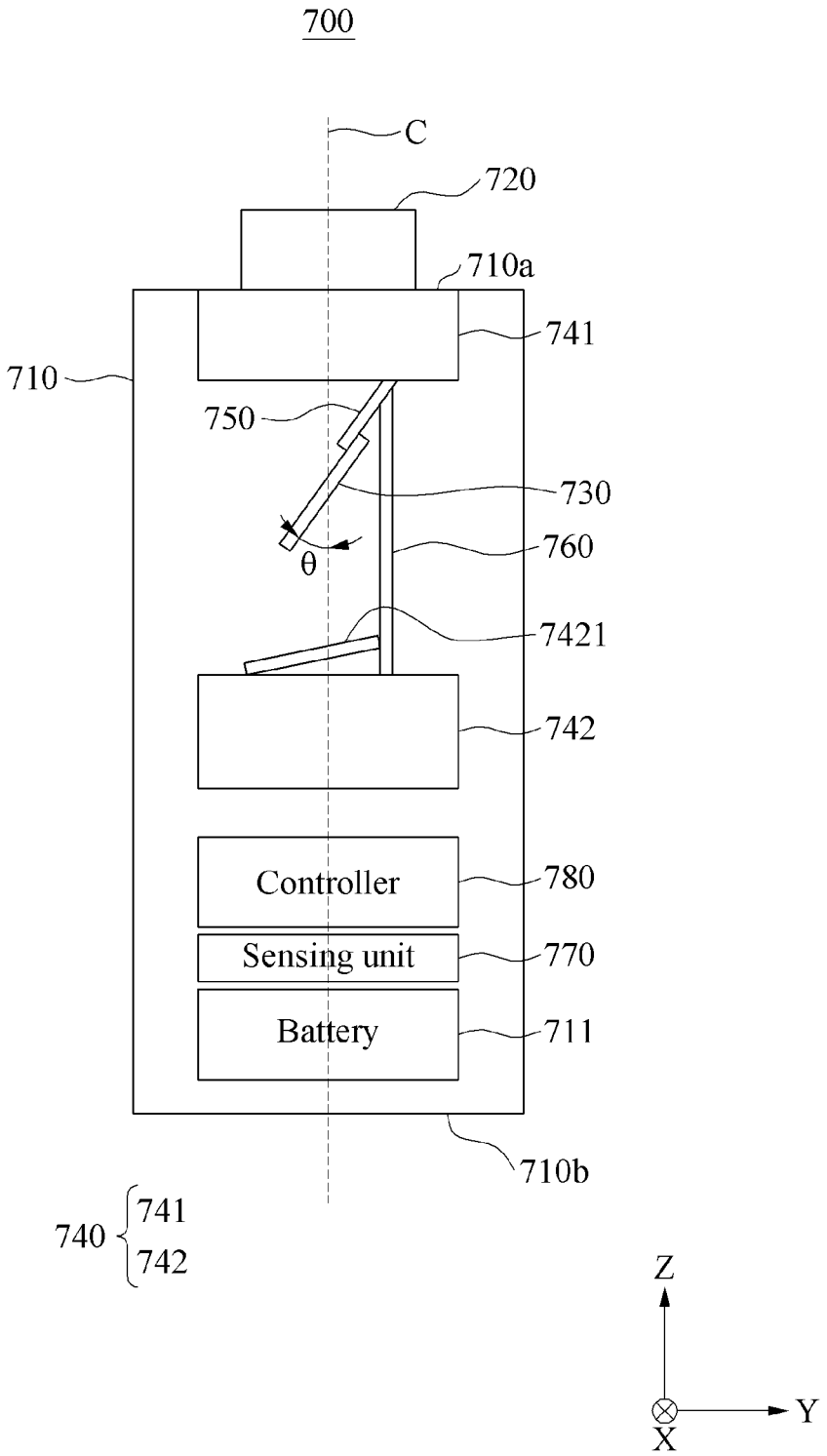
FIG. 8 is a side view of an aerosol generating device showing its internal components according to an embodiment.
Figure 9:
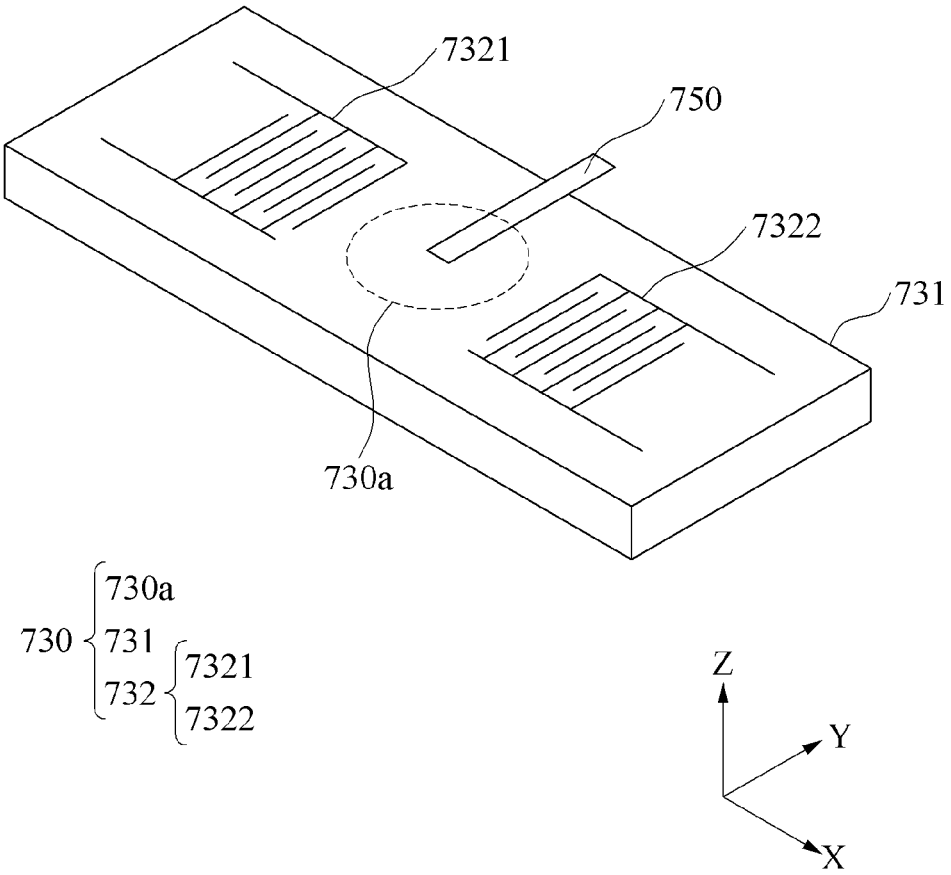
FIG. 9 is a perspective view of an aerosol generator according to an embodiment.

FIG. 7 is a front view of an aerosol generating device showing its internal components according to an embodiment, FIG. 8 is a side view of the aerosol generating device showing its internal components according to an embodiment, and FIG. 9 is a perspective view of an aerosol generator according to an embodiment.

Referring to FIGS. 7 to 9, an aerosol generating device 700 according to an embodiment may generate an aerosol. For example, the aerosol generating device 700 may aerosolize a liquid stored in a cartridge 740 using a principle of surface acoustic wave (SAW). In an embodiment, the aerosol generating device 700 may atomize an aerosol forming substrate stored in the cartridge 740. According to an embodiment, the aerosol generating device 700 may include a housing 710, a battery 711, a mouth side end 720, an aerosol generator 730, the cartridge 740, a wick 750, a connecting member 760, a sensing unit 770, and a controller 780.

In an embodiment, the housing 710 may be configured to accommodate various electronic/mechanical components. In an embodiment, the battery 711, the sensing unit 770, the controller 780, the aerosol generator 730, and the cartridge 740 may all be accommodated in the housing 710 and safely protected from an external stimulus (e.g., dust, impact, heat, etc.). In an embodiment, the housing 710 may have a first surface 710*a* and a second surface 710*b*. In an embodiment, the second surface 710*b* may face the first surface 710*a*.

In an embodiment, the mouth side end 720 may be used by a user to inhale an aerosol from the aerosol generating device 700. For example, a mouthpiece or an insertion part for receiving an inhalation article (e.g., a cigarette) may be disposed at the mouth side end 720. In an embodiment, the mouth side end 720 is a portion that touches a mouth of the user, and an aerosol may be transferred to the user through a liquid flow path included in the mouth side end 720. In an embodiment, the mouth side end 720 may be disposed on the first surface 710*a* of the housing 710. For example, the mouth side end 720 may be disposed to touch the first surface 710*a* of the housing 710.

In an embodiment, the cartridge 740 may store at least one aerosol forming substrate. For example, the aerosol forming substrate may include an aerosol generating material having any one of various states, such as a liquid state, a solid state, a gaseous state, and a gel state. The aerosol generating material may include a liquid composition. For example, the liquid composition may be a liquid including a tobacco-containing material having a volatile tobacco flavor component or may be a liquid including a non-tobacco material. In an embodiment, the cartridge 740 may be operated by an electrical signal or a wireless signal transmitted from the main body to perform the function of generating an aerosol by converting the phase of the aerosol generating material inside the cartridge 740 to a gaseous phase. The aerosol may refer to a gas in which vaporized particles generated from the aerosol generating material are mixed with air. In an embodiment, the aerosol forming substrate stored in the cartridge 740 may include the same material or different materials.

In an embodiment, the cartridge 740 may store a functional material (not shown) that may be used as an aerosol forming substrate. In an embodiment, the functional material may be stored in the cartridge 740 in a form of at least one of a gaseous phase, a liquid phase, or a solid phase. In an embodiment, the functional material may include a fragrance such as nicotine, glycerin, propylene glycol, menthol, a drug for the treatment of respiratory diseases such as asthma, chronic obstructive pulmonary disease, and the like, oil such as aromatic oil, caffeine, taurine, vaccines, and the like. The functional material is not limited to the examples described above and may include various materials. In an embodiment, the functional material stored in the cartridge 740 may be the same or different. For example, when a plurality of cartridges 740 is provided and a functional material stored in each of the plurality of cartridges 740 is the same, at least one cartridge 740 of the plurality of cartridges 740 may serve as a spare. When different functional materials are stored in the cartridges 740, one of the cartridges 740 may be selected and aerosolized based on a user preference.

Hereinafter, a description is provided based on an assumption that a homogeneous aerosol forming substrate is stored in the cartridge 740.

In an embodiment, the cartridge 740 may be disposed in the housing 710. In an embodiment, the cartridge 740 may include a first reservoir 741 and a second reservoir 742. In an embodiment, the first reservoir 741 may be disposed adjacent to the first surface 710*a* of the housing 710. For example, the first reservoir 741 may be disposed adjacent to the mouth side end 720. The first reservoir 741 may store the aerosol forming substrate.

In an embodiment, the second reservoir 742 may be disposed to be spaced apart from the first reservoir 741 along a longitudinal direction (e.g., a Z-axis direction of FIG. 7) of the housing 710. For example, the second reservoir 742 may be disposed on an opposite side of the first reservoir 741 with the aerosol generator 730 to be described later interposed therebetween. In an embodiment, a guide member 7421 may be disposed at the second reservoir 742. In an embodiment, the guide member 7421 may guide the aerosol forming substrate to flow into the second reservoir 742. The guide member 7421 may be inclinedly disposed on an upper side of the second reservoir 742 with respect to a central axis C (i.e., Z-axis in FIG. 8). For example, a portion of the aerosol forming substrate supplied from the first reservoir 741 to the aerosol generator 730 may flow into the second reservoir 742 along a gravity direction (e.g., −Z axis direction of FIG. 8) by gravity. In this case, the aerosol forming substrate may first touch the guide member 7421 and then slowly slide toward the second reservoir 742. The guide member 7421 may reduce noise generated when the aerosol forming substrate drops into the second reservoir 742 and may prevent the aerosol forming substrate stored in the second reservoir 742 from overflowing.

In an embodiment, the first reservoir 741 and the second reservoir 742 may be integrally formed. In this case, the first reservoir 741 and the second reservoir 742 may be attached to and detached from the housing 710 together. In another embodiment, the cartridge 740 may be configured such that the first reservoir 741 is omitted and only the second reservoir 742 is provided. In this case, the aerosol forming substrate stored in the second reservoir 742 may be supplied to the aerosol generator 730 through the connecting member 760 and the wick 750.

In an embodiment, the aerosol generator 730 may aerosolize the aerosol forming substrate stored in the cartridge 740. For example, an SAW may be used as a scheme for generating an aerosol. The SAW may be generated using a piezoelectric material capable of mutually converting electrical energy and mechanical energy. For example, it may be possible to generate an SAW that propagates along a surface according to contraction or expansion of a piezoelectric material by patterning an interdigital transducer on the surface of the piezoelectric material in a desired form through a semiconductor etching process and applying an alternating current (AC) voltage with an operating frequency corresponding to a spacing of the transducer. An acoustic wave force of the SAW may aerosolize a fluid or microparticles in a microdroplet and a microfluidic channel. Sizes of particles of an aerosol generated using an SAW may be fine and uniform. In an embodiment, the aerosol generator 730 may aerosolize the aerosol forming substrate stored in the cartridge 740 using an SAW. However, embodiments are not limited thereto, and the aerosol generator 730 may aerosolize the aerosol forming substrate in various ways, for example, through heating using a heater. Hereinafter, aerosolization using an SAW is described as an example.

In an embodiment, the aerosol generator 730 may be connected to the cartridge 740. For example, the aerosol generator 730 may be connected to the first reservoir 741 through the wick 750.

In an embodiment, the aerosol generator 730 may include a substrate 731, a transducer 732, and an atomization region 730*a*.

The substrate 731 may form a surface on which an SAW is transferred. The substrate 731 may include a plate shape. The substrate 731 may be inclined at a predetermined angle θ with respect to the central axis C which is parallel to the longitudinal direction of the housing 710. For example, the angle θ formed between the substrate 731 and the central axis C may be an acute angle. As the substrate 731 is inclinedly disposed with respect to the central axis C of the housing 710, the aerosol forming substrate stored in the first reservoir 741 may flow on a surface of the substrate 731 towards the second reservoir 742 by gravity.

The atomization region 730*a* may be located on the surface of the substrate 731. The atomization region 730*a* may be a region in which the aerosol forming substrate is aerosolized through the transducer 732 and an aerosol is generated. Since the substrate 731 is inclined with respect to the gravity direction (e.g., −Z direction of FIG. 8), the atomization region 730*a* may also be inclinedly disposed with respect to the gravity direction. In this case, the atomization region 730*a* may be disposed under the wick 750 in the gravity direction. The transducer 732 may be disposed such that the SAW is directed toward the atomization region 730*a*.

The transducer 732 may convert electrical energy received from the battery 711 into kinetic energy, and an acoustic wave may be generated by the kinetic energy generated by the transducer 732. As the acoustic wave propagates along the surface of the substrate 731 having elasticity, the SAW may vibrate the aerosol forming substrate supplied from the wick, causing aerosolization of droplets through atomization.

In an embodiment, the wick 750 may transfer the aerosol forming substrate stored in the first reservoir 741 and/or the second reservoir 742 to the aerosol generator 730. For example, the wick 750 may be one of porous members such as a wick capable of transferring an aerosol forming substrate. In an embodiment, the wick 750 may connect the first reservoir 741 and the aerosol generator 730. For example, a first end of the wick 750 may be connected to the first reservoir 741, and a second end may be connected to the aerosol generator 730. The wick 750 may receive the aerosol forming substrate through the first end or a connecting member 760 to be described later. Since the second end of the wick 750 overlaps at least a portion of the atomization region 730*a* on the surface of the substrate 731, the aerosol forming substrate may form a uniform and thin liquid film on the surface of the substrate 731.

In an embodiment, the connecting member 760 may connect the wick 750 and the second reservoir 742. For example, one end of the connecting member 760 may be connected to the wick 750 and another end may be connected to the second reservoir 742. The connecting member 760 may transfer the aerosol forming substrate stored in the second reservoir 742 to the wick 750. The connecting member 760 may transfer the aerosol forming substrate, which has moved from the first reservoir 741 to the second reservoir 742 along the surface of the substrate 731 by gravity, to the wick 750. For example, the connecting member 760 may transfer the aerosol forming substrate stored in the second reservoir 742 to the wick 750 by capillary action. The connecting member 760 may include a porous member such as a wick.

In an embodiment, the transducer 732 may include a first transducer 7321 and a second transducer 7322. The first transducer 7321 and the second transducer 7322 may be disposed on the substrate 731 to face each other across the atomization region 730*a*.

In an example, the first transducer 7321 and the second transducer 7322 may be configured to convert electrical energy into kinetic energy and generate an SAW as a result of the kinetic energy propagating along the surface of the substrate 731. Since both the first transducer 7321 and the second transducer 7322 are configured as transmitters capable of generating SAWs and transmitting each SAW to the wick 750, an amount of atomization may be easily increased.

In another example, the first transducer 7321 may be configured as a transmitter that generates an SAW, and the second transducer 7322 may be configured as a receiver that receives the SAW transmitted by the first transducer 7321. Since the first transducer 7321 transmits the SAW and the second transducer 7322 receives the SAW, a defective transmission/reception of the SAW may be detected and an operating state of the aerosol generating device 700 may be effectively monitored.

Figure 10:
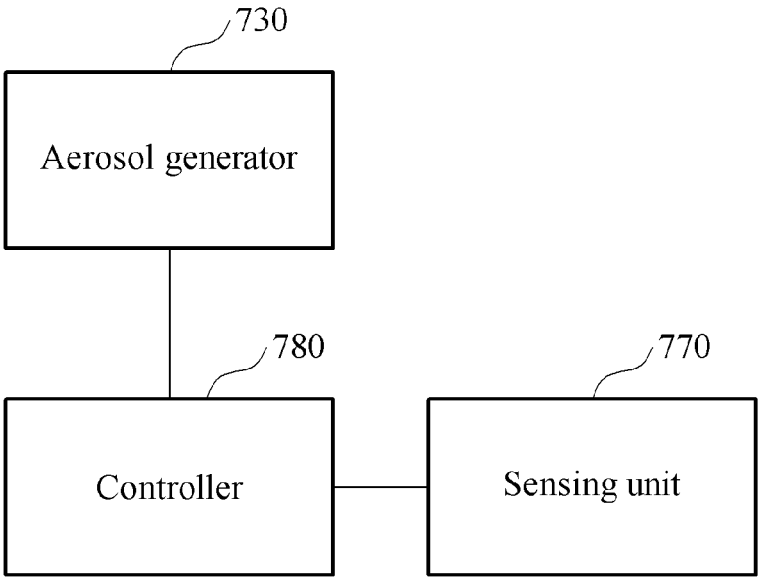
FIG. 10 is a block diagram illustrating an operation of an aerosol generating device according to an embodiment.

FIG. 10 is a block diagram illustrating an operation of an aerosol generating device according to an embodiment.

Referring to FIG. 10, an aerosol generating device (e.g., the aerosol generating device 700 of FIG. 7) according to an embodiment may include the aerosol generator 730 that generates an aerosol by aerosolizing an aerosol forming substrate, the sensing unit 770 that detects a state of the aerosol generating device, and the controller 780 that controls an operation of the aerosol generating device.

In an embodiment, the sensing unit 770 may detect an internal or external state of the aerosol generating device. For example, the sensing unit 770 may include a tilt sensor (e.g., a gyro sensor) capable of detecting a degree of inclination of the aerosol generating device with respect to a direction (e.g., the Z-axis direction of FIG. 8) perpendicular to the ground.

In an embodiment, the controller 780 may control the operation of the aerosol generating device. For example, the controller 780 may control the operation of the aerosol generating device depending on the internal or external state of the aerosol generating device detected by the sensing unit 770. In an embodiment, the controller 780 may control an angle (e.g., the angle θ of FIG. 8) formed by the aerosol generator with respect to a central axis (e.g., the central axis C of FIG. 8) parallel to a longitudinal direction (e.g., the Z-axis direction of FIG. 8) of a housing (e.g., the housing 710 of FIG. 8), based on the degree of inclination of the aerosol generating device detected by the sensing unit 770. For example, the controller 780 may detect a tilted state of the aerosol generating device and substantially maintain an angle formed by the aerosol generator with respect to the central axis of the housing to remain constant, thereby preventing malfunctions from occurring even if a user tilts the aerosol generating device during its use.

Hereinafter, the operation of the aerosol generating device 700 according to an embodiment is described with reference to FIGS. 7 to 10.

In an embodiment, the aerosol forming substrate stored in the first reservoir 741 may be supplied to the aerosol generator 730 through the wick 750. The aerosol generator 730 may generate an aerosol in the atomization region 730*a* through the substrate 731 and the transducer 732. The remainder of the aerosol forming substrate, which has failed to be aerosolized in the aerosol generator 730, may flow through an inclined surface of the substrate 731 towards the second reservoir 742 by gravity. The guide member 7421 is disposed on the second reservoir 742 so that the guide member 7421 may guide the remainder of the aerosol forming substrate to flow into the second reservoir 742. The aerosol forming substrate stored in the second reservoir 742 may flow through the connecting member 760, for example, using capillary action, into the wick 750, causing aerosolization of the remainder of the aerosol forming substrate.

Since the aerosol generating device 700 according to an embodiment may aerosolize the aerosol forming substrate such that the aerosol forming substrate is composed of particles of a uniform size and supply the aerosolized aerosol forming substrate to the atomization region 730*a*, it may be possible to proactively prevent efficiency degradation issues in the transducer 732 that may arise due to uneven thickness.

Furthermore, the aerosol generating device 700 according to an embodiment effectively recirculates the remainder of the aerosol forming substrate, thereby preventing droplet aggregation caused by the remainder of the aerosol forming substrate and enabling effective reuse of the remainder of the aerosol forming substrate.

Although the embodiments have been described with reference to the limited drawings, one of ordinary skill in the art may apply various technical modifications and variations based thereon. For example, suitable results may be achieved if the described techniques are performed in a different order and/or if components in a described system, architecture, device, or circuit are combined in a different manner and/or replaced or supplemented by other components or their equivalents.

Therefore, other implementations, other embodiments, and equivalents of the claims are within the scope of the following claims.

The invention claimed is:

1. An aerosol generating device comprising:

a housing having a first surface and a second surface opposite to the first surface;

a mouth side end disposed on the first surface;

at least one cartridge disposed in the housing and configured to store an aerosol forming substrate, wherein the at least one cartridge comprises:

a first reservoir disposed closer to the first surface than to the second surface; and a second reservoir disposed to be spaced apart from the first reservoir in a longitudinal direction of the housing; and an aerosol generator connected to the at least one cartridge and configured to generate an aerosol, wherein the aerosol generator comprises:

a substrate comprising a plate shape;

at least one transducer disposed on the substrate; and an atomization region on a surface of the substrate, in which the aerosol is generated, wherein the substrate is disposed in the housing to form an acute angle with respect to a central axis that is parallel to the longitudinal direction of the housing, the longitudinal direction being a direction from the first surface toward the second surface, and wherein the at least one transducer is configured to convert an electrical signal into a surface acoustic wave (SAW), and the SAW is transferred to the atomization region through the substrate to aerosolize the aerosol forming substrate.

2. The aerosol generating device of claim 1, wherein the second reservoir is disposed to face the first reservoir across the aerosol generator.

3. The aerosol generating device of claim 1, wherein the aerosol forming substrate stored in the first reservoir flows through the surface of the substrate into the second reservoir along a gravity direction.

4. The aerosol generating device of claim 1, further comprising:

a wick configured to transfer the aerosol forming substrate to the aerosol generator, wherein a first end of the wick is connected to the first reservoir, and a second end of the wick is connected to the aerosol generator.

5. The aerosol generating device of claim 4, wherein the second end of the wick is disposed to overlap at least a portion of the atomization region.

6. The aerosol generating device of claim 5, further comprising:

a connecting member configured to transfer the aerosol forming substrate stored in the second reservoir to the wick, wherein an end of the connecting member is connected to the wick, and another end of the connecting member is connected to the second reservoir.

7. The aerosol generating device of claim 1, wherein the at least one transducer comprises a plurality of transducers, and the plurality of transducers is disposed to face each other across the atomization region.

8. The aerosol generating device of claim 7, wherein the at least one transducer comprises:

a first transducer configured to transmit the SAW to the atomization region; and a second transducer configured to transmit the SAW to the atomization region.

9. The aerosol generating device of claim 7, wherein the at least one transducer comprises:

a first transducer configured to transmit the SAW to the atomization region; and a second transducer configured to receive the SAW transmitted from the first transducer.

10. The aerosol generating device of claim 1, further comprising:

a sensing unit configured to detect an internal or external state of the aerosol generating device; and a controller configured to control an operation of the aerosol generating device depending on the internal or external state of the aerosol generating device detected by the sensing unit.

11. The aerosol generating device of claim 10, wherein the sensing unit comprises a tilt sensor configured to detect a degree of inclination of the aerosol generating device, and the controller is configured to adjust an angle formed by the aerosol generator with respect to the central axis according to the degree of inclination of the aerosol generating device detected by the tilt sensor.

12. An aerosol generating device comprising:

a housing having a first surface and a second surface opposite to the first surface;

a mouth side end disposed on the first surface;

a first reservoir disposed closer to the first surface than to the second surface, and configured to store an aerosol forming substrate;

a second reservoir disposed to be spaced apart from the first reservoir in a longitudinal direction of the housing, the longitudinal direction being a direction from the first surface toward the second surface, and configured to store an aerosol forming substrate;

an aerosol generator connected to the first reservoir and configured to generate an aerosol;

a wick configured to connect the first reservoir and the aerosol generator, and transfer the aerosol forming substrate to the aerosol generator; and a connecting member configured to connect the wick and the second reservoir, and transfer the aerosol forming substrate stored in the second reservoir to the wick, wherein the aerosol generator comprises at least one transducer disposed on a substrate, and the transducer is configured to convert an electrical signal into a surface acoustic wave (SAW).

13. The aerosol generating device of claim 12, wherein the substrate comprises a plate shape, and wherein the aerosol generator comprises:

an atomization region on a surface of the substrate, in which an aerosol is generated, wherein the SAW aerosolizes the aerosol forming substrate.

14. The aerosol generating device of claim 13, wherein the substrate is disposed in the housing to form an acute angle with respect to a central axis that is parallel to the longitudinal direction of the housing, the aerosol forming substrate stored in the first reservoir flows through the surface of the substrate into the second reservoir along a gravity direction, and the aerosol forming substrate stored in the second reservoir flows through the connecting member into the wick.

* * * * *